US006041509A

United States Patent [19]

Shelyago

[11] Patent Number: 6,041,509

[45] Date of Patent: Mar. 28, 2000

[54] METHOD AND DEVICE FOR DETERMINING A SPACE POSITION OF THE AXIS OF A CASED WELL

[76] Inventor: Vladimir Viktorovich Shelyago, Universitetsky pr., d. 9, kv. 425, 117296 Moscow, Russian Federation

[21] Appl. No.: 08/738,819

[22] Filed: Oct. 28, 1996

[30] Foreign Application Priority Data

Mar. 14, 1996 [RU] Russian Federation ..... 96104227

[51] Int. Cl.[7] ..... E21B 47/022; G01C 9/00

[52] U.S. Cl. ..... 33/304; 33/313; 33/544

[58] Field of Search ..... 33/304, 302, 308, 33/313, 542, 544, 544.1, 544.3

[56] References Cited

U.S. PATENT DOCUMENTS

| | | | |
|---|---|---|---|
| 4,192,077 | 3/1980 | Van Steenwyk et al. . | |
| 4,199,869 | 4/1980 | Van Steenwyk | 33/304 |
| 4,611,405 | 9/1986 | Van Steenwyk | 33/304 |
| 4,835,876 | 6/1989 | Petermann et al. | 33/304 |

OTHER PUBLICATIONS

"Directional Surveying of Wells", V. Kh. Isachenko, Nedra PH, 1987 (English translation) (No Month Provided).

*Primary Examiner*—Christopher W. Fulton
*Attorney, Agent, or Firm*—Hardaway/Mann IP Group

[57] ABSTRACT

The essence of the proposed method resides in that assumed as the datum point of measurement of the well azimuth is an azimuthally stabilized housing of a down-the-hole inclinometer and the magnitude of the azimuth is determined by measuring the angle of rotation of the housing of the down-the-hole instrument (1) round its longitudinal axis, which rotation occurs in response to an azimuthal deviation of the longitudinal axis of a well (5). According to a first embodiment of the proposed device, it comprises a plurality of spring-loaded arcuate elements (3) secured on an external surface (2) of the housing of the down-the-hole instrument (1) so as to form at least three rows, each row consisting of at least three elements (3), each of the latter establishing, together with an internal surface (4) of the well (5), a contact spot (6) whose portion having a greater size (h) is arranged lengthwise the longitudinal axis of the well (5).

7 Claims, 3 Drawing Sheets

METHOD AND DEVICE FOR DETERMINING A SPACE POSITION OF THE AXIS OF A CASED WELL

FIELD OF THE INVENTION

The present invention relates in general to geophysics and more specifically, to a method and device for determining a space position of the axis of a cased well.

The invention can find application in the oil and gas industry for monitoring a space position of the axis of a cased well or any other hole. The herein-proposed method and device for determining inclination and direction (directional surveying) of cased wells can be applied not only to producer wells but also in the drilling operation by running a down-the-hole instrument (inclinometer) in a well tubing without pulling the latter from the well, which makes it possible to effect permanent monitoring of the space position of the axis of an inclined well being constructed during its drilling. This substantially accelerates the construction process of such wells and adds to the accuracy of well hole drilling, as well as cuts down expenses for constructing inclined wells due to low cost of the proposed method for directional surveying of cased wells.

BACKGROUND OF THE INVENTION

Lack of data on the space position of the axes of the now-operating cased wells and on an accurate position of their bottomholes in the pattern of the oil or gas fields under development prevents one from developing such fields at a required technical level.

The bores of the wells of the aforesaid operating well stock precludes application of the use of geomagnetic fields for determining an azimuthal deviation of the well axes. However, too sophisticated construction, high cost, and inadequate accuracy of the gyroscopic inclinometer systems which make use of the principal axis of a gyroscopic system for determining an azimuthal deviation of the well axis, impede one to solve said problem to a sufficient extent.

A prior-art method and device for determining a space position of the longitudinal axis of a cased well U.S. application Ser. No. 4,192,077, filed Mar. 11, 1980. The method provides for obtaining output data of azimuthal measurement, using a free gyroscope and a rate-of-turn gyroscope during displacement of equipment in the well being surveyed.

It is evident that a combination of a free gyroscope and a rate-of-turn gyroscope contributes to the fact that advantageous features of each of said gyroscopes (i.e., an adequate accuracy of the rate-of-turn gyroscope and a higher surveying rate of the free gyroscope give as total result exceeding that of the two gyroscopes taken individually.) For instance, in the event of a power interruption, a tumbled free gyroscope can be reoriented by using the output date of the rate-of-turn gyroscope, obviating any need to bring the free gyroscope back into the well for realignment.

However, use of an azimuth of the principal axis of the gyroscopes results in an azimuthal error, since the space position of the principal axis of each gyroscope is affected adversely by dynamic loads the gyroscopes are exposed to during the round trip of equipment, rotation of the Earth, and some other factors that are hardly amenable or unamenable altogether to elimination. Furthermore, the gyroscopes in question feature a sophisticated construction arrangement which adds much to the cost of the process of directional surveying of wells.

Other prior-art methods and devices for directional surveying of cased well are known (cf. a textbook "Directional surveying of wells" by V.Kh.Isachenko, Moscow, Nedra PH, 1987, pp. 17–20, 78–83 (in Russian).

The aforementioned method is carried into effect with the aid of a down-the-hole instrument-inclinometer, and a ground-level until for receiving, processing, and displaying the output data obtained from said inclinometer.

The housing of the instrument accommodates a sensor of the zenith angle of the well being surveyed and a gyroscopic system for determining the azimuth of the well.

It is due to the aforesaid gyroscopic system retaining the space direction of its principal axis that enables one to measure the well azimuth without using the geomagnetic field, that is, in cased wells.

However, the space position of the gyroscopic system principal axis is affected adversely by dynamic loads the instrument is exposed to during its round trip to the well being surveyed, as well as by rotation of the instrument round its longitudinal axis, rotation of the Earth, and the like factors, which change the space position of said axis that serves as the datum point of the azimuthal measurement. This in turn involves a considerable error (of the order of plus-minus $10_o$) in azimuth determination. On the other hand, measures taken to eliminate said adverse factors necessitate inevitably increased overall dimensions of the gyroscopic system and hence those of the down-the-hole instrument as a whole, which is far from being always practicable under conditions of each specific well, or lead to a constructional sophistication of the gyroscopic system and hence to a much higher cost of the device. Moreover, use of the gyroscopic system involves practical implementation of the method in question more technologically complicated, which is due to a prolonged period of tuning the system and of the process proper of directional surveying of the well being surveyed.

SUMMARY OF THE INVENTION

It is a principal object of the present invention to attain a more accurate determination of the azimuthal deviation of the axis of the cased well being surveyed by eliminating the impact of a number of adverse factors that are liable to vary by virtue of diverse reasons, on the position of the datum point of the azimuthal measurement and hence a more accurate determination of the space position of the longitudinal axis of the well being surveyed.

It is another object of the invention to simplify the construction arrangement of the device allowing for high-accuracy determination of the space position of the axis of a cased well and of finding an accurate position of its bottomhole.

It is a further object of the present invention to render the process of directional surveying of a cased well less expensive due to a simplified tuning of the down-the-hole instrument and a simplified directional surveying process as a whole.

The foregoing and further objects are accomplished due to the provision of a method for determining the space position of the axis of a cased well, the method making use of equipment comprising a down-the-hole instrument having a sensor of the angle of rotation of said down-the-hole instrument and a sensor of the zenith angle of the longitudinal axis of the well being surveyed. The method consists of the following operations:

placing the down-the-hole instrument at the mouth of the well being surveyed;

azimuthal stabilizing of the instrument at the well mouth in such a manner that any point on the surface of the instrument does not change its azimuthal direction while running the instrument into the well, and an azimuthal deviation of the longitudinal axis of the well causing the instrument to rotate round its longitudinal axis through an angle equal to the angle of azimuthal deviation of the longitudinal axis of the well;

fixing the azimuthal direction of the azimuthally stabilized instrument and determining the datum point for measuring the angle of rotation of the instrument round its longitudinal axis in response to an azimuthal deviation of the longitudinal axis of the well;

running the instrument into the well;

measuring the magnitude of the zenith angle of the longitudinal axis of the well using the zenith angle sensor;

obtaining the processed output data from the sensor of the zenith angle of the instrument, the data being indicative of the magnitude of the zenith angle of the longitudinal axis of the well during the measurement of the angle;

measuring, by means of the sensor of the angle of rotation of the instrument, the magnitude of the angle of rotation of the instrument round its longitudinal axis with respect to the datum point, the rotation resulting from an azimuthal deviation of the longitudinal axis of the well during the running-in of the instrument;

obtaining the processed output data from the sensor of the angle of rotation of the instrument, the data being indicative of the magnitude of the angle of rotation of the instrument round its longitudinal axis during the measurement of the magnitude of the angle, the magnitude being equal to the magnitude of the azimuthal deviation of the longitudinal axis of the well;

determining the space position of the longitudinal axis of the well by the processing the output data on the magnitude of the zenith angle and of the angle of the azimuthal deviation of the longitudinal axis of the well, obtained from the measurements.

According to the proposed method, assumed as the datum point of the azimuth of the well being surveyed is an azimuthally fixed position of the down-the-hole instrument, which position is unaffected by the factors unamenable to elimination, such as rotation of the Earth, dynamic loads arising during round trips of equipment, and the like.

As a result, the accuracy of measuring the azimuth of the well being surveyed and hence of the space position of the axis of the cased well as a whole is greatly increased.

The foregoing objects are accomplished also due to the provision of a device for determining the space position of the longitudinal axis of a cased well, comprising:

a down-the-hole instrument-inclinometer;

a means for supporting the instrument for a length of travel along the longitudinal axis of the cased well being surveyed;

a plurality of spring-loaded arcuate elements held to the external side surface of the instrument and forming at least three transverse rows, each of the rows consisting of at least three such elements;

each of the plurality of spring-loaded elements being so secured on the external side surface of the instrument as to establish, together with the internal surface of the well, a contact spot whose greater portion is arranged lengthwise the longitudinal axis of the well;

the plurality of spring-loaded arcuate elements which azimuthally stabilize the instrument against a change in the azimuthal direction of each point on its surface while running the down-the-hole instrument into the well being surveyed and cause the down-the-hole instrument to rotate round its longitudinal axis in response to a change in the azimuthal direction of the longitudinal axis of the well while running the down-the-hole instrument into the well, through an angle whose magnitude is equal to that of the angle of the azimuthal deviation of the longitudinal axis of the well;

the down-the-hole instrument having a sensor of the angle of rotation of the instrument round its longitudinal axis in response to a change in the azimuthal direction of the longitudinal axis of the well while running the instrument into the well;

the angle of rotation sensor having a fixed value with a stabilized, by means of the plurality of spring-loaded arcuate elements, azimuthal direction of the down-the-hole instrument, the fixed value being assumed as the datum point of the angle of rotation of the down-the-hole instrument;

the down-the-hole instrument having a sensor of the zenith angle of the longitudinal axis of the well;

a ground-level unit for receiving, processing, and displaying the output data obtained from the angle of rotation sensor and the zenith angle sensor;

a means for transmitting the output data, establishing communication between the angle of rotation sensor and the ground-level unit;

a means for transmitting the output data, establishing communication between the zenith angle sensor and the ground-level unit.

The fact that the proposed device is free from complicated gyroscopic systems simplifies much the construction arrangement thereof and adds to the accuracy of determining the azimuth of the well being surveyed and hence the space position of the longitudinal axis of a cased well due to azimuthal stabilization of the down-the-hole instrument with the aid of the plurality of spring-loaded arcuate elements. While running-in the down-the-hole instrument, its housing retains the azimuthal direction imparted thereto at the well mouth, till reaching the bottomhole.

The aforementioned azimuthal stabilization of the housing of the down-the-hole instrument by means of the spring-loaded elements enables the latter to slide over the inner surface of a casing string arranged in the well being surveyed and to serve at the same time as the centralizer of the down-the-hole instrument. The construction arrangement of each of the spring-loaded elements provides for the shape of its contact area with the casing, the area having a maximum size lengthwise the axis of the casing string. Such a nature of the contact rules out an azimuthal deviation of the housing of the down-the-hole instrument during the running-in procedure. The aforestated number of the rows of spring-loaded elements on the surface of the down-the-hole instrument, as well as their number in each row depends on the required degree of accuracy of azimuthal stabilization.

The spring-loaded stabilizing elements may be of different construction arrangement. However, any construction solution of the elements must necessarily satisfy the above-mentioned requirements imposed thereon, e.g., be in the form of spring-loaded skids, and the like.

To overcome the force of friction arising at the places of contact of the spring-loaded elements with the inner surface of the casing, as well as with the purpose of a stepless motion of the down-the-hole instrument over inclined well sections and hence of reducing dynamic loads, it is expedient that the down-the-hole instrument has a means for its weighing.

A fixed position of the azimuthally stabilized down-the-hole instrument serves as the datum point of measuring the azimuth of the longitudinal axis of the well being surveyed, much as the datum point of azimuthal measurement in the directional surveying systems operating in open well bores is the magnetic needle of a dip compass, and in the gyroscopic directional surveying systems, the principal axis of the gyroscopic system.

An azimuthal deviation of the longitudinal well axis causes the azimuthally stabilized down-the-hole instrument to rotate round its longitudinal axis through an angle whose magnitude equals that of the angle of azimuthal deviation of the longitudinal well axis. Otherwise, the angle of rotation of an azimuthally stabilized down-the-hole instrument is direct parameter of the angle of azimuthal deviation of the longitudinal well axis.

Determining the azimuthal direction of a "zero" value of the sensor of the angle of rotation of the down-the-hole instrument round its longitudinal axis with a fixed azimuthal position of the instrument enables one to assume the azimuthal direction as the datum point of measuring the azimuth of the longitudinal well axis, which azimuth is determined while running the down-the-hole instrument into the well be measuring the angle of rotation of the down-the-hole instrument round its longitudinal axis, which precludes an adverse effect of the factors that are liable to vary by virtue of diverse reasons, on the position of the datum point of the azimuthal measurement and hence adds to the accuracy of determining the space position of the longitudinal axis of the well being surveyed.

The proposed device is free from complicated gyroscopic systems which simplifies its construction arrangement due to a simplified tuning of the down-the-hole instrument and of the directional surveying process as a whole. Whenever the spring-loaded elements cannot be arranged on the surface of the housing of the down-the-hole instrument due to too a small gap between the inner casing surface and the external surface of the down-the-hole instrument, the foregoing objects are accomplished due to the provision of a device for determining the space position of a cased well, comprising:

a down-the-hole instrument-inclinometer having a hollow housing;

a rod arranged coaxially with the housing of the down-the-hole instrument-inclinometer and connected with its one end to the housing so as to make it impossible for the rod to rotate with respect to the housing;

a means for supporting the instrument and the rod for a length of their travel along the longitudinal axis of the cased well being surveyed;

a plurality of spring-loaded arcuate elements held to the external side surface of the rod so as to form at least three transverse rows, each of the rows consisting of at least three such elements;

each of the plurality of spring-loaded elements being so secured on the external side surface of the rod as to establish, together with the internal surface of the well, a contact spot whose grater portion is arranged lengthwise the longitudinal axis of the well;

the plurality of spring-loaded arcuate elements which azimuthally stabilize the rod against a change in the azimuthal direction of each point on its surface while running the rod into the well being surveyed and cause the rod to rotate round its longitudinal axis in response to a change in the azimuthal direction of the longitudinal axis of the well while running the rod into the well, through an angle whose magnitude is equal to that of the angle of the azimuthal deviation of the longitudinal axis of the well;

the rod azimuthally stabilizing the housing of the down-the-hole instrument against a change in the azimuthal direction of any point on the surface thereof while running the housing into the well being surveyed and causing the housing to rotate round its longitudinal axis in response to a change in the azimuthal direction of the longitudinal axis of the well while running the housing into the well, through an angle whose magnitude is equal to that of an azimuthal deviation of the longitudinal axis of the well;

a sensor of the angle of rotation of the housing round its longitudinal axis in response to a change in the azimuthal direction of the longitudinal axis of the well while running said down-the-hole instrument into the well while running the down-the-hole instrument into said well, said sensor being accommodated in the housing and having a fixed value with a stabilized, by means of said rod, azimuthal direction of the housing, the fixed value with a stabilized, by means of the rod, azimuthal direction of the of the housing, the fixed value being assumed as the datum point of the angle of rotation;

a sensor of the zenith angle of the longitudinal axis of the well, accommodated in said housing;

a ground-level unit for receiving, processing, and displaying the output data obtained from the angle of rotation sensor and the zenith angle sensor;

a means for transmitting the output data, establishing communication between the sensor of the angle of rotation of the housing and the ground-level unit;

a means for transmitting the output data, establishing communication between the zenith angle sensor and the ground-level unit.

The aforesaid spring-loaded elements are in this case arranged on a rod of an appropriate diameter so connected to the housing of the down-the-hole instrument as to prevent both of them from rotating relative to each other, which allows one to judge of attaining an azimuthal stabilization of the housing of the down-the-hole instrument, featuring all the advantages described before.

In this case it is desirable, with a view to aligning the down-the-hole instrument with the longitudinal well axis, that the device has a means for retaining the housing of the down-the-hole instrument in a required position.

Additionally, the device may comprise a means for weighting the down-the-hole instrument.

Thus, azimuthal stabilization of the housing of the down-the-hole instrument and provision of a zenith angle sensor and a sensor of the angle of rotation of the housing of the down-the-hole instrument round its longitudinal axis allows of high-accuracy directional surveying of a cased well without using sophisticated gyroscopic systems, which simplifies much the construction arrangements of the device and reduces the cost of the directional surveying process.

The down-the-hole instrument is placed at the mouth of the well being surveyed. Then, the instrument is azimuthally stabilized at the well mouth in such a manner that any point on the surface thereof does not change its azimuthal direction while running the instrument into the well, and an azimuthal deviation of the well causes the instrument to rotate round its longitudinal axis through an angle equal to the angle of an azimuthal deviation of the longitudinal axis of the well being surveyed. Next, the azimuthal direction (e.g., North alignment) of the stabilized instrument is fixed and there is determined the datum point for measuring the angle of rotation of the instrument round its longitudinal axis in response to an azimuthal deviation of the well being surveyed. Thereupon, the instrument is lowered into the well, and the magnitude of the zenith angle of the longitudinal well axis is measured and that of the angle of rotation of the instrument round its longitudinal axis, which is equal to the magnitude of the azimuthal deviation of the longitudinal well axis is measured. Finally, one obtains the processed output data of the measured quantities against which the space position of the longitudinal axis of the well being surveyed is determined.

The herein-proposed method will hereinafter be considered in more detail with reference to the description of the proposed device.

BRIEF DESCRIPTION OF THE DRAWINGS

To promote understanding, a detailed description of some exemplary embodiments of the present invention is set forth hereinbelow with reference to the appended drawings, wherein.

DETAILED DESCRIPTION OF THE PREFERRED EMBODIMENTS

Figure 1:
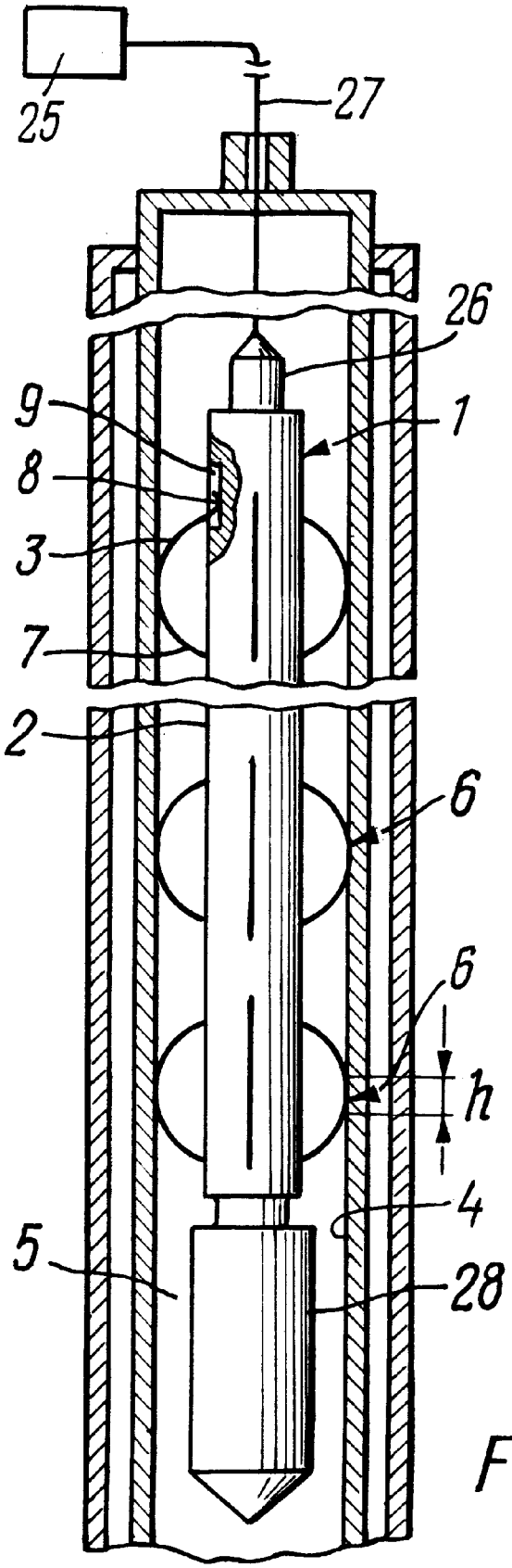
FIG. 1 is a general schematic partly cut-away view of a device for determining the space position of the axis of cased well, according to the invention.

The device for determining the space position of a cased well, according to the invention, comprises a down-the-hole instrument 1 (FIG. 1). The external side surface 2 (cylinder-shaped in this particular example) of the instrument 1 carries a plurality of spring-loaded arcuate elements 3. These elements are arranged in at least three rows, and each row comprises at least three such elements. It is preferred that the rows of the elements are spaced apart uniformly along the vertical of the instrument 1 and along the periphery of the external side surface 2 of the instrument 1. The number of rows and of the elements 3 in each rod depends on the measurement accuracy required. It is preferable that the number of rows equals seven and the number of elements 3 in each row equals four.

Each of the plurality of spring-loaded elements 3 may be of any heretofore-known construction making possible its holding to the external side surface 2 of the instrument 1 so as to establish, together with an internal surface 4 of a well 5 being surveyed, a contact spot 6 having its greater portion arranged lengthwise the longitudinal axis of the well 5 being surveyed. For instance, each element 3 may be made from a spring wire having a diameter of, e.g., 2 mm, a first end 7 of said element 3 being fixed stationary on the surface 2 of the instrument 1, and a second end 8 thereof is longitudinally movable along a respective slot 9 on the surface 2, each of the slots 9 being oblong in shape lengthwise the longitudinal axis of the instrument 1. Such a construction arrangement of the spring-loaded elements 3 enables them to form, together with the internal surface 4 of the well 5, the ellipsoidal contact spot 6 having its greater portion arranged lengthwise the longitudinal axis of the well 5.

Said plurality of the spring-loaded elements 3 stabilizes azimuthally the instrument 1 against a change in the azimuthal direction of each point on its surface 2 while running the instrument 1 into the well 5. As a result, the spring-loaded elements 3, each having the aforementioned spot 6 of contact with the internal surface 4 of the well 5, cause the instrument 1 to rotate round its longitudinal axis in response to a change in the azimuthal direction of the longitudinal axis of the well 5 while running the instrument 1 thereinto. This can be explained by the fact that the force of friction which arise when all the spring-loaded elements 3 turn relative to the internal surface 4 of the well 5 and which is to be overcome by the instrument 1 in order to rotate in the well 5 and change its azimuthal direction, exceeds incomparably the force of friction which the instrument is to overcome in order to turn about its longitudinal axis so as to retain its azimuthal direction.

Thus, the aforesaid nature of the contact rules out any azimuthal deviation of the instrument 1 during its running into the well 5 and causes it to rotate round its longitudinal axis through an angle whose magnitude is equal to that of the angle of the azimuthal deviation of the longitudinal axis of the well 5.

Figure 2:
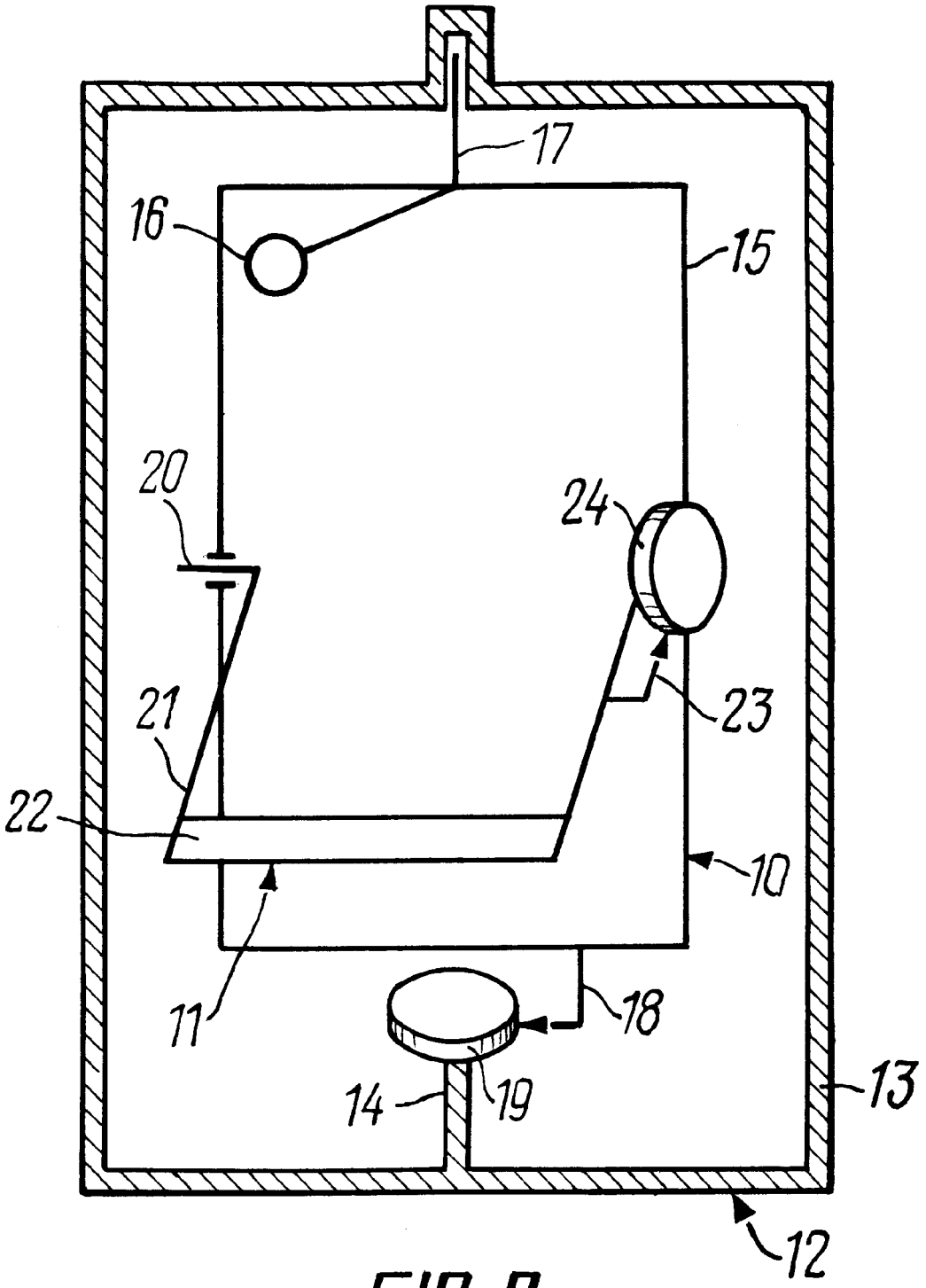
FIG. 2 is a schematic view of a sensor of the zenith angle sensor and of a sensor of the angle of rotation of the down-the-hole instrument, according to the invention.

The down-the-hole instrument 1 has a sensor 10 of the angle of rotation of the down-the-hole instrument 1 round its longitudinal axis in response to a change in the azimuthal direction of the longitudinal axis of the well 5, and a sensor 11 of the zenith angle of the longitudinal axis of the well 5. Both of the sensors 10 and 11 may be of any heretofore-known construction aimed at attaining similar purposes. FIG. 2 presents a kinematic diagram of a practicable construction arrangement of the zenith angle sensor 11 and the sensor 10 for determining the angle of rotation of a down-the-hole instrument (inclinometer) 12 round its longitudinal axis. With the aforesaid construction arrangement of the sensors 10 and 11, the down-the-hole instrument 12 has a hollow housing 13 with an internal surface 14. The housing 13 of the down-the-hole instrument 12 accommodates an outer gimbal frame 15 with an off-center bob-weight 16 and an axis 17 of rotation arranged coaxially with the longitudinal axis of the down-the-hole instrument 12. In its lower portion the outer gimbal frame 15 has a current collector 18 which contacts a slide-wire 19 rigidly bound with the internal surface 14 of the housing 13 of the down-the-hole instrument 12. An axis 20 of rotation of an inner gimbal frame 21 is arranged in the plane of the outer gimbal frame 15 square with the axis of its rotation. The inner gimbal frame 21 features an offset center of gravity which is due to an off-center bob-weight 22. The axis 20 of rotation carries a current collector 23 contacting a slide-wire 24 which is rigidly held to the outer gimbal frame 15. The outer gimbal frame 15 with the off-center bob-weight 16, the axis 17 of rotation, the current collector 18, and the slide-wire 19 constitute the sensor 10 of the angle of rotation of the down-the-hole instrument 12 round its longitudinal axis. The inner gimbal frame 21 having the axis 20 of rotation, the bob-weight 22, the current collector 23, and the slide-wire 24 constitute the sensor 11 of the zenith angle of the longitudinal well axis. The angle of turn sensor 10 has a fixed value with a stabilized azimuthal direction (e.g. North alignment) of the instrument 12, which is assumed as the datum point of measuring the angle of rotation of the instrument 12.

The device comprises also a ground-level unit 25 for receiving, processing and displaying the output data obtained from the sensors 10 and 11, said unit being of any heretofore-known construction intended for similar purposes, and means for transmitting the output data from the respective sensors 10, 11 to the ground-level unit 25. The means may also be of any heretofore-known construction, e.g., they may comprise a cable head 26 (FIG. 1) which is connected, via a logging cable 27, to the ground-level unit 25. In this case the logging cable 27 performs the function of a means for retaining the instrument 1 throughout the length of its travel along the longitudinal axis of the well 5, which means may also be of any heretofore-known construction.

Figure 3:
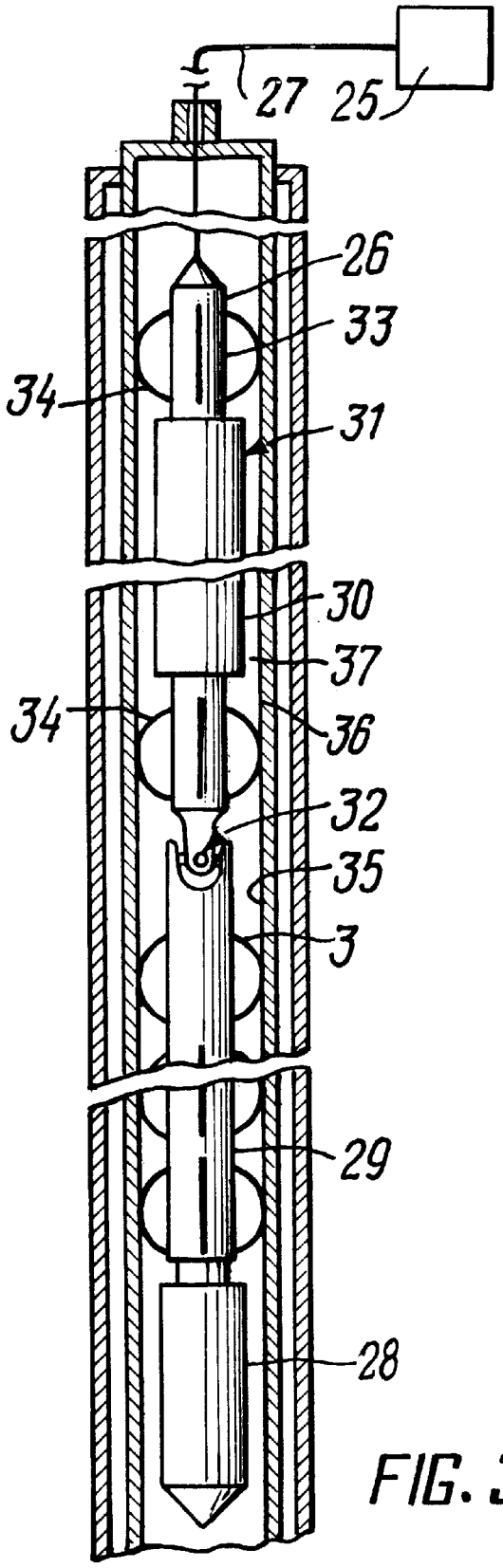
FIG. 3 is an alternative embodiment of the device of FIG. 2.

The device of the invention may also comprise a means for weighting the instrument 1 appearing as, e.g., a bob-weight 28 held from below to the instrument 1. Said weighting means may also be located elsewhere in the instrument 1. FIG. 3. displays an alternative embodiment of the construction arrangement of the proposed device, wherein the spring-loaded elements 3 are situated on a separate metal rod 29 connected to a housing 30 of a down-the-hole instrument (inclinometer) 31 through a cardan joint 32 which keeps the rod 29 against rotation relative to the housing 30. Besides, the joint between the rod 29 and housing 30 may be of any other construction arrangement that ensure against rotation of the rod 29 with respect to the housing 30.

Journals 33 are provided at the ends of the housing 30 of the down-the-hole instrument 31 on which aligning elements are fitted, appearing similarly to, e.g., the stabilizing spring-loaded elements 3. The metal rod 29 is linked to the weighting bob-weight 28. The stabilizing spring-loaded elements 3 and aligning elements 34 are in contact with an internal surface 35 of a casing string 36 in a well 37 being surveyed.

All the abovedescribed with reference to the stabilizing spring-loaded elements 3 located on the down-the-hole instrument 1 applies equally to the stabilizing spring-loaded elements 3 located on the rod 29. In this case the rod 29 stabilizes azimuthally the housing 30 of the instrument 31 against any change in the azimuthal direction of any point on the surface thereof during its running into the well 37 and causes the housing to rotate round its longitudinal axis, in response to a change in the azimuthal direction of the longitudinal well axis, through an angle whose magnitude equals that of an azimuthal deviation of the longitudinal axis of the well 37.

The herein-proposed device operates as follows:

Before running the down-the hole instrument inclinometer 1 into the well 5, one is to determine the azimuthal direction of the sensor 10 of the angle of rotation of the down-the-hole instrument 1 round its longitudinal axis 17. To this aim, the down-the-hole instrument 1 is positioned at an angle of 45° to the terrestrial surface so that the lower end of the instrument 1 faces towards the magnetic north of the Earth and its upper end, towards the magnetic south. Then the down-the-hole instrument 1 is rotated until the sensor 10 of the angle of rotation of the down-the-hole instrument indicates the "zero" value. As a result, the outer gimbal frame 15, while rotating about the axis 17 due to the off-center bob-weight 16, assumes the position square with the apsidal plane, i.e., the plane established by the vertical and the direction of the zenith angle. The slide-wire 19, while rotating along with the down-the-hole instrument 1, points with its "zero" position to the current collector 18. Next, the down-the-hole instrument 1, is inserted into the casing string having preliminarily connected the bob-weight 28 thereto, without changing its azimuthal direction obtained beforehand, with the result, that the spring-loaded elements 3 are compressed while moving with its vacant end 8 along the slots 9. As a result of the aforedescribed operations, the "zero" value of the sensor 10 of the angle of rotation of the down-the-hole instrument 1 corresponds to the azimuthal deviation to the magnetic north of the longitudinal axis of the well, and pressing the spring-loaded elements 3 against the inner surface of the casing string provides for aligning the down-the-hole instrument 1 and its azimuthal stabilization due to the shape of the spot of contact of the spring-loaded elements 3 with the casing string, elongated lengthwise the longitudinal axis of the well 5.

Then the azimuthally stabilized down-the-hole instrument 1 is inserted into the well 5. An azimuthal deviation of the longitudinal axis of the well 5 during the running-in procedure causes the down-the-hole instrument 1 to rate round its longitudinal axis 17. During the running-in procedure, one is to measure the zenith and azimuthal angles of the longitudinal axis of the well 5 and to read the indications of the respective sensors 11 and 10 of the zenith angle and the angle of rotation of the down-the-hole instrument 1, whereupon the processed information from said sensors is transmitted, via the logging cable 27, to the ground-level unit 28 to be displayed there.

The operation of the down-the-hole equipment presented in FIG. 3 differs from that described before only in determining the azimuthal direction of the sensor 10 of the angle of rotation of the housing 30 of the down-the-hole instrument 31 round its longitudinal axis.

The metal rod 29 with the stabilizing spring-loaded elements 3 on its outer surface and the bob-weight 28 connected from below thereto, is inserted into the casing string 36. The spring-loaded elements 3 get compressed to provide an azimuthal stabilization of the metal rod 29 as has been described before. The housing 30 of the down-the-hole instrument 31 carrying the elastic aligning elements 34 fitted on its journals 33, is connected, through the cardan joint 32, to the metal rod 29. The cardan joint 32 ensures against mutual rotation of the housing 30 of the down-the hole instrument 31 and the metal rod 29. Thus, the housing 30 of the down-the-hole instrument 31 becomes azimuthally stabilized while still out of the casing string 36.

This provides for rotation of the housing 30 round its longitudinal axis 17 when the upper end thereof performs circular motion. The azimuthal direction of the longitudinal axis 17 of the down-the-hole instrument 31, wherein the sensor 10 of the angle of rotation of the housing 30 of the down-the-hole instrument 31 reads "zero", is assumed as the datum point of measurements of the azimuthal angles of the longitudinal well axis while running the down-the-hole instrument 31 into the well 37.

Once the thus-obtained azimuthal direction has been fixed, the down-the-hole instrument 31 is inserted into the casing string 36, with the result that the elastic aligning elements 34 get compressed and, while contacting the inner surface of the casing string, align down-the-hole instrument 31.

EXAMPLES OF PRACTICAL EMBODIMENT

Example 1

The longitudinal axis of a cased well 2560 m deep is directionally surveyed with a view to estimating the position of its bottomhole in the layout of the oil field being developed. A pipe string having an inside diameter of 875 mm is inserted into the well. A static liquid level in the well equals 1150 m.

The down-the-hole instrument-inclinometer has a metal housing having a diameter of 48 mm and a length of 1200 mm. The housing 1 has a number of holes 2 mm in diameter and 5 mm deep, adapted to receive the stationary fixed ends of the spring-loaded elements, as well as a number of slots 3 mm deep, 2.2 mm wide, and 60 mm long, adapted for the free bent out end of the spring-loaded elements to slide along when said elements are compressed. Both the holes and the slots are arranged in four rows lengthwise the longitudinal axis of the housing, each row consisting of seven holes or slots. The spring-loaded elements are made from normalized spring wire 2 mm in diameter and 150 mm long. A total number of the spring-loaded elements is twenty eight; they are arranged on the surface of the housing of the down-the-hole instrument-inclinometer in four symmetrical rows, seven in each row. This enables one to ensure a required degree of accuracy of azimuthal stabilization and alignment of the housing of the down-the-hole instrument-inclinometer. The housing of the down-the-hole instrument-inclinometer accommodates the sensor of the zenith angle and the sensor of the angle of rotation of the housing of the down-the-hole instrument round its longitudinal axis, said sensors being in fact the heretofore-known sine-cosine transformers having an outside diameter of 32 mm, as well as electronic circuits for processing signals delivered by said sensors, and circuits for transmitting the processed signals to the ground-level until which communicates, through a single-core logging cable and a cable head, with the down-the-hole instrument.

A hollow steel weighter 60 mm in diameter and 1500 mm long filled with lead shot is connected to the lower portion of the down-the-hole instrument-inclinometer through a threaded joint.

The ground-level unit receives, converts, and displays information delivered from the down-the-hole instrument.

The housing of the down-the-hole instrument-inclinometer is rotated at the well mouth till the "zero" position of the sensor of the angle of rotation of the down-the-hole instrument-inclinometer, whereupon the housing of the down-the-hole instrument-inclinometer is inserted into the pipe string, having connected the weighter beforehand. As a result, the spring-loaded arcuate elements are compressed to align the housing of the down-the-hole instrument-inclinometer and stabilize it against rotation. Then, the housing of the down-the-hole instrument-inclinometer inserted into the pipe string, is lowered into the well. While running the pipe string into the well, measurements are taken, every ten meters, of the signals delivered from the slide-wires through the current collectors and the logging cable to the ground-level unit, thus measuring the angle of rotation of the housing of the down-the-hole instrument-inclinometer round its longitudinal axis (which is equal to the azimuthal angle), and the zenith angle.

The directional surveying procedure is carried out four times in succession, whereupon a space well axis is plotted by the results of measurements taken, and the bottomhole location is estimated in the layout of the oil field. The space position of the points on the longitudinal well axis is determined with the error below 0.3 m for every 500 m of the well depth, and a maximum scatter of the bottomhole position is not in excess of 5 m.

Example 2

The longitudinal axis of a cased oil well 2340 m deep is directionally surveyed with a view to estimating the position of its bottomhole in the layout of the oil field being developed. A pipe string having an inside diameter of 62 mm is inserted into the well. A static liquid level in the well equals 1100 m.

Use is made of the same down-the-hole instrument-inclinometer as in Example 1, its outside diameter being 48 mm and length, 1200 mm. Eight elastic aligning elements are fitted on the instrument journals (four at each end) made of normalized spring wire 2 mm in diameter. The construction and arrangement of said elements are similar to those of the stabilizing spring-loaded elements.

It is due to a small gasp between the inner pipe string surface and the surface of the housing of the down-the-hole instrument that the spring-loaded elements are arranged on a metal rod 25 mm in diameter and 1200 mm long which is connected, through a cardan joint, to the housing of the down-the-hole instrument-inclinometer.

The spring-loaded elements are similar to those described in Example 1 as to the construction, type of metal, and arrangement on the metal rod surface.

The directional surveying of the well is performed as follows. The metal rod carrying on its surface the spring-loaded stabilizing elements and mounting the weighter connected thereto from below, is placed at the well mouth. Then the housing of the down-the-hole instrument-inclinometer which is still out of the pipe string is connected, by means of the cardan joint, to the upper portion of the metal rod. Next the upper end of the housing of the down-the-hole instrument-inclinometer is rotated while retaining an angle of inclination of its longitudinal axis to the Earth's surface equal to 45 degrees, and the azimuthal direction of the longitudinal axis of the housing of the down-the-hole instrument-inclinometer is noticed at which the sensor of the angle of rotation of the housing of the down-the-hole instrument indicates the "zero" value. Thereupon the housing of the down-the-hole instrument-inclinometer is inserted into the pipe string and is lowered into the well together therewith. As the down-the-hole instrument-inclinometer is running into the well, the zenith and azimuthal angle of the well are measured every 15 m of the well depth by reading their magnitudes off the ground-level unit.

Otherwise the directional surveying procedure and the error involved do not differ noticeable from those described in Example 1.

Example 3

The longitudinal axis of a cased oil well 2480 m deep is directionally surveyed with a view to estimating the position of its bottomhole in the layout of the oil field being developed. A pipe string having an inside diameter of 75 mm is inserted into the well. n A static liquid level in the well equals 1050 m.

Used as the down-the-hole instrument is a known magnetic inclinometer (cf. the textbook "Directional surveying of wells" by V.Kh.Isachenko, Moscow, Nedra PH, 1987, pp.62–66, in Russian), the diameter of the down-the-hole instrument being 60 mm. The elastic aligning elements are fitted on the journals of the down-the-hole instrument-inclinometer as described in Example 2. The housing of the down-the-hole instrument-inclinometer is connected, through a cardan joint, to a metal rod 38 mm in diameter and 1200 mm long which carried on its surface the spring-loaded stabilizing elements as described in Example 2.

A narrow-directional permanent magnet is located on the housing of the down-the-hole instrument-inclinometer, aimed at "fixing" the magnetic needle of the compass to the housing of the down-the-hole instrument-inclinometer. This makes it possible to turn the magnetic azimuthal sensor of the magnetic inclinometer into a sensor of the angle of rotation of the down-the-hole instrument-inclinometer round its longitudinal axis.

Otherwise the directional surveying procedure and the error involved do not differ noticeably from those described in Example 1.

Example 4

The longitudinal axis of a cased oil well 2630 m deep is directionally surveyed with a view to estimating the position of its bottomhole in the layout of the oil field being developed. A pipe string having an inside diameter of 75 mm is inserted into the well. A static liquid level in the well equals 1180 m.

Used as the down-the-hole instrument is the gyroscopic inclinometer (refer to the prototype) having a diameter of 36 mm.

The arcuate spring-loaded elements are arranged on the surface of the housing of the down-the-hole instrument-inclinometer as described in Example 1, while the outer gimbal frame of the gyroscope is held mechanically to the housing of the down-the-hole instrument-inclinometer, which makes it possible to render the azimuthal angle sensor of the gyroscopic inclinometer into the sensor of the angle of rotation of the down-the-hole instrument-inclinometer round its longitudinal axis.

Otherwise the directional surveying procedure and the error involved do not differ noticeably from those described in Example 1.

It is noteworthy that the examples described before should by no means be considered as exhausting further possible construction variants of the proposed invention.

What we claim is:

1. A method of determining the space position of the axis of a cased well, said method comprising the steps of:

providing a down-the-hole instrument-inclinometer having a sensor of the angle of rotation of said down-the-hole instrument-inclinometer, a sensor of the zenith angle of the longitudinal axis of the well being surveyed, and a plurality of azimuthally stabilizing spring-loaded arcuate elements:

placing the down-the-hole instrument-inclinometer at the mouth of the well being surveyed;

azimuthal stabilizing of said instrument at said well mouth in such a manner that any point on the surface of said instrument does not change its azimuthal direction while running said instrument into said well, and an azimuthal deviation of the longitudinal axis of said well causes said instrument to rotate round its longitudinal axis, using said plurality of spring-loaded elements, through an angle equal to the angle of azimuthal deviation of said longitudinal axis of said well;

fixing the azimuthal direction of said azimuthally stabilized instrument and determining the datum point for measuring said angle of rotation of said instrument round its longitudinal axis in response to an azimuthal deviation of said longitudinal axis of said well;

running said instrument into said well;

measuring the magnitude of the zenith angle of said longitudinal axis of said well using said zenith angle sensor;

obtaining the processed output data from said sensor of the zenith angle of said instrument, said data being indicative of the magnitude of the zenith angle of said longitudinal axis of said well during said measurement of said angle;

measuring, by means of said sensor of the angle of rotation of said instrument, the magnitude of said angle of rotation of said instrument round its longitudinal axis with respect to said datum point, said rotation resulting from an azimuthal deviation of said longitudinal axis of said well during said running-in of said instrument;

obtaining the processed output data from said sensor of the angle of rotation of said instrument, said data being indicative of the magnitude of said angle of rotation of said instrument round its longitudinal axis during said measurement of the magnitude of said angle, said magnitude being equal to the magnitude of the azimuthal deviation of said longitudinal axis of said well; and determining the space position of said longitudinal axis of said well by processing said output data on the magnitude of said zenith angle and of said angle of the azimuthal deviation of the longitudinal axis of said well, obtained from said measurements.

2. A device for determining the space position of the longitudinal axis of a cased well, comprising:

a down-the-hole instrument-inclinometer;

a means for supporting said instrument for a length of travel along the longitudinal axis of the cased well being surveyed;

a plurality of spring-loaded arcuate elements held to the external side surface of said instrument and forming at least three transverse rows, each of said rows consisting of at least three such elements;

each of said plurality of spring-loaded elements being so secured on said external side surface of said instrument so as to establish, together with the internal surface of said well, a contact spot whose greater portion is arranged lengthwise said longitudinal axis of said well;

said plurality of spring-loaded arcuate elements azimuthally stabilizing said instrument against change in the azimuthal direction of each point on its surface while running said down-the-hole instrument-inclinometer into said well being surveyed and cause said down-the-hole instrument-inclinometer to rotate round its longitudinal axis in response to a change in the azimuthal direction of the longitudinal axis of said well while running said down-the-hole instrument-inclinometer into said well, through an angle whose magnitude is equal to that of the angle of the azimuthal deviation of said longitudinal axis of said well;

said down-the-hole instrument-inclinometer having a sensor of the angle of rotation of said instrument round its longitudinal axis in response to a change in the azimuthal direction of said longitudinal axis of said well while running said instrument into said well;

said angle of rotation sensor having a fixed value with a stabilized, by means of said plurality of spring-loaded arcuate elements, azimuthal direction of said down-the-hole instrument-inclinometer, said fixed value being assumed as the datum point of said angle of rotation of said down-the-hole instrument-inclinometer;

said down-the-hole instrument-inclinometer having a sensor of the zenith angle of the longitudinal axis of said well;

a ground-level unit for receiving, processing, and displaying the output data obtained from said angle of rotation sensor and said zenith angle sensor;

a means for transmitting said output data, establishing communication between said angle of rotation sensor and said ground-level unit; and a means for transmitting said output data, establishing communication between said zenith angle sensor and said ground-level unit.

3. A device as set forth in claim 2, comprising a means for weighting said down-the-hole instrument-inclinometer.

4. A device for determining the space position of a cased well, comprising:

a down-the-hole instrument-inclinometer having a hollow housing;

a rod arranged coaxially with said housing of said down-the-hole instrument-inclinometer and connected with its one end to said housing so as to make it impossible for said rod to rotate with respect to said housing;

a means for supporting said instrument and said rod for a length of their travel along the longitudinal axis of the cased well being surveyed;

a plurality of spring-loaded arcuate elements held to the external side surface of said rod so as to form at least three transverse rows, each of said rows consisting of at least three such elements;

each of said plurality of spring-loaded elements being so secured on said external side surface of said rod so as to establish, together with the internal surface of said well, a contact spot whose greater portion is arranged lengthwise said longitudinal axis of said well;

said plurality of spring-loaded arcuate elements azimuthally stabilizing said rod against a change in the azimuthal direction of each point on its surface while running said rod into said well being surveyed and cause said rod to rotate round its longitudinal axis in response to a change in the azimuthal direction of the longitudinal axis of said well while running said rod into said well, through an angle whose magnitude is equal to that of the angle of the azimuthal deviation of said longitudinal axis of said well;

said rod azimuthally stabilizing said housing of said down-the-hole instrument-inclinometer against a change in the azimuthal direction of any point on the surface thereof while running said housing into said well being surveyed and causing said housing to rotate round its longitudinal axis in response to a change in the azimuthal direction of the longitudinal axis of said well while running said housing into said well, through an angle whose magnitude is equal to that of an azimuthal deviation of said longitudinal axis of said well;

a sensor of the angle of rotation of said housing round its longitudinal axis in response to a change in the azimuthal direction of the longitudinal axis of said well while running said down-the-hole instrument-inclinometer into said well, said sensor being accommodated in said housing and having a fixed value with a stabilized, by means of said rod, azimuthal direction of said housing, said fixed value being assumed as the datum point of said angle of rotation;

a sensor of the zenith angle of said longitudinal axis of said well, accommodated in said housing;

a ground-level unit for receiving, processing, and displaying the output data obtained from said angle of rotation sensor and said zenith angle sensor;

a means for transmitting the output data, establishing communication between said sensor of the angle of rotation of said housing and said ground-level unit; and a means for transmitting the output data, establishing communication between said zenith angle sensor and said ground-level unit.

5. A device as set forth in claim 4, comprising a means for aligning said housing of said down-the-hole instrument-inclinometer in said well being surveyed.

6. A device as set forth in claim 4, comprising a means for weighting said down-the-hole instrument-inclinometer.

7. A device as set forth in claim 5, comprising a means for weighting said down-the-hole instrument-inclinometer.

* * * * *